United States Patent [19]

Mullins

[11] 3,996,765

[45] Dec. 14, 1976

[54] REFRIGERANT SYSTEM CHARGING AND EVACUATING MANIFOLD

[76] Inventor: John W. Mullins, P.O. Box 20524, Oklahoma City, Okla. 73120

[22] Filed: Oct. 6, 1975

[21] Appl. No.: 620,087

Related U.S. Application Data

[63] Continuation-in-part of Ser. No. 518,822, Oct. 29, 1974, Pat. No. 3,916,641.

[52] U.S. Cl. ..... 62/292; 62/77; 62/125; 141/311 R; 141/348

[51] Int. Cl.[2] ..... F25D 45/00

[58] Field of Search ..... 62/77, 125, 149, 292; 141/311, 348; 137/228, 229

[56] References Cited

UNITED STATES PATENTS

| | | | |
|---|---|---|---|
| 2,226,851 | 12/1940 | Franck | 62/125 |
| 2,464,563 | 3/1949 | Doeg | 62/292 |
| 3,618,644 | 11/1971 | Grise | 62/292 |
| 3,645,496 | 2/1972 | Rawlins | 62/292 |

*Primary Examiner*—William E. Wayner
*Assistant Examiner*—Ronald C. Capossela
*Attorney, Agent, or Firm*—Robert K. Rhea

[57] ABSTRACT

A device for servicing closed refrigerating systems comprising a body having a passageway therethrough provided at its respective ends with threaded members for connecting the device to an access valve of the refrigerant system and a refrigerant charging hose. The body rotatably supports a shaft having a camming surface at one end longitudinally moving a plunger toward a depressible valve core by manual rotation of the shaft for communication with the refrigerant system.

4 Claims, 6 Drawing Figures

REFRIGERANT SYSTEM CHARGING AND EVACUATING MANIFOLD

CROSS-REFERENCE TO RELATED APPLICATION

This application is a continuation-in-part of an application filed by me in the U.S. Patent and Trademark Office on Oct. 29, 1974, Ser. No. 518,822 for REFRIGERANT SYSTEM CHARGING AND EVACUATING MANIFOLD now U.S. Pat. No. 3,916,641.

BACKGROUND OF THE INVENTION

1. Field of the Invention

The present invention relates to closed refrigerating systems and more particularly to a manifold for removing or adding fluid refrigerant to the system.

The term "refrigerating system" as used herein is intended to mean any system which utilizes a compressible evaporative fluid to remove heat from an enclosed space, such as refrigerators and air conditioners. The maintenance of such a system requires that the refrigerant system be tested and additional refrigerant fluid added thereto if the fluid contained by the system is below a predetermined pressure. Similarly, a malfunctioning refrigerant system sometimes must be evacuated or refrigerant fluid in order to effect repairs and thereafter recharge the system. For this purpose the refrigerant lines are usually provided with one or more access fittings which contain a spring urged depressible stem for opening and closing a valve core which is utilized by the present invention in servicing the system.

2. Description of the Prior Art

Most refrigerant servicing devices of this type, commonly referred to as charging manifolds, are bulky in overall configuration and are provided with two or more valves which must be opened and closed during operation. The passageway through the prior art devices and valves being of relatively small size are consequently inefficient when evacuating refrigerant fluid from the lines.

This invention provides a relatively small in overall configuration charging and evacuating manifold, when compared with prior art manifolds, having a refrigerant passageway therethrough which is substantially greater in cross sectional area than the full open position of the access fitting valve with which it is connected for easily conveying the volume of gas being added to or removed from the refrigerant system and which contains a cam equipped shaft for moving a plunger toward and away from a depressible valve core stem for opening and closing the valve. The manifold disclosed herein is distinctive over the manifold disclosed by the above named copending application by further minimizing the overall dimensions of the manifold thus conserving material, simplifying the configuration and number of components and eliminating one fluid seal.

SUMMARY OF THE INVENTION

In one embodiment a housing or body is provided with a through bore intersected by a lateral bore forming a right angular passageway having threaded means at one end of the through bore for connection with a refrigerant charging hose and having other threaded means at its other end for connection with a refrigerant access valve. The other end portion of the through bore axially receives a shaft having a cam surface at one end portion for opening the access valve by longitudinally moving an elongated access valve core depressing plunger axially disposed in the leg of the right angular fluid passageway adjacent the refrigerant access valve by rotating the shaft 180°. The other end portion of the shaft extends beyond the body for manually rotating the shaft and controlling the position of its camming surface. A second 180° rotation of the shaft and its camming surface permits the spring urged valve core stem to longitudinally move the plunger with the cam and close the access valve.

In another embodiment, a lateral threaded port, formed in the body opposite the access valve connecting means, receives a pressure/vacuum gauge communicating with the refrigerant system each time the cam opens the access valve.

The principal object of this invention is to provide an improved refrigerant system servicing manifold for attachment to a refrigeration access valve without loss of refrigerant for quickly evacuating a refrigerant system of refrigerant fluid or adding fluid as needed and which is relatively small in overall dimensions.

DESCRIPTION OF THE PREFERRED EMBODIMENTS

Figure 1:
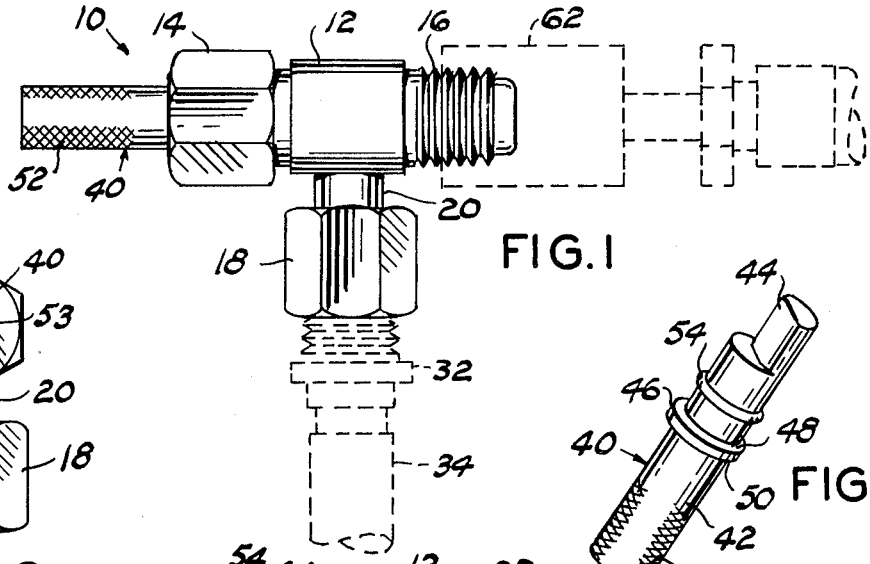
FIG. 1 is a side elevational view of the device illustrating, by dotted lines, its connection with a refrigerant access valve and one end portion of a charging hose.
Figure 2:
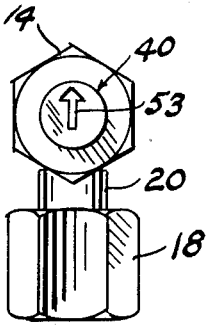
FIG. 2 is a left end elevational view of FIG. 1.
Figure 5:
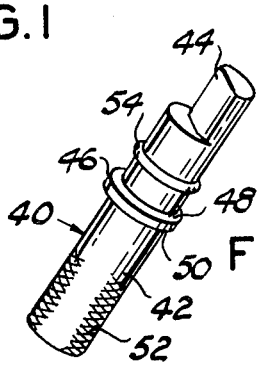
FIG. 5 is a perspective view of the cam equipped rotatable shaft, per se.
Figure 3:
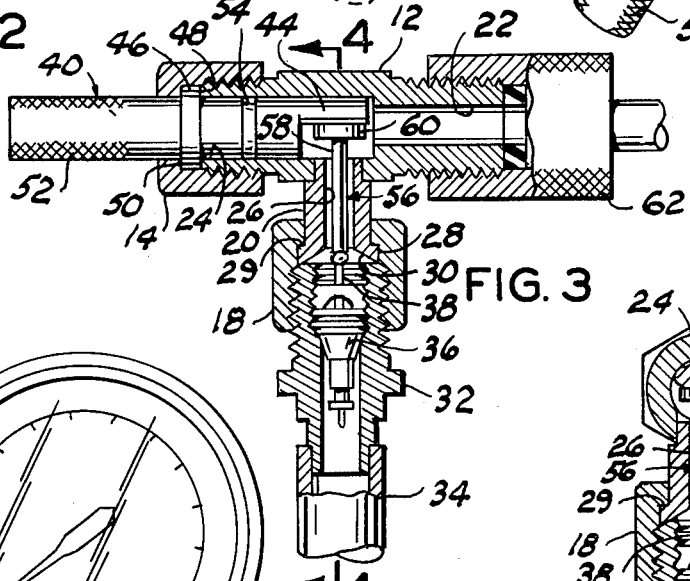
FIG. 3 is a fragmentary vertical cross sectional view, partially in elevation, of the manifold and components shown in FIG. 1.
Figure 4:
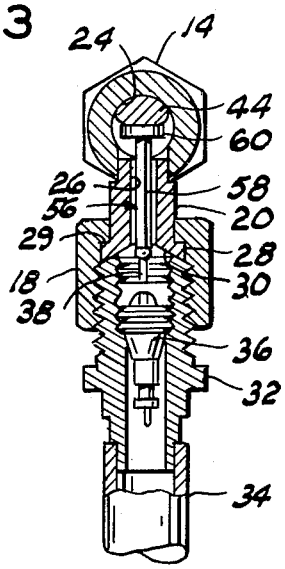
FIG. 4 is a fragmentary vertical cross sectional view taken substantially along the line 4—4 of FIG. 3.

Like characters of reference designate like parts in those figures of the drawings in which they occur.

In the drawings:

Referring to FIGS. 1 through 5, the reference numeral 10 indicates the device, as a whole, which is generally T-shaped in its preferred form comprising a cross bar 12 of the T-shape having first and second connectors 14 and 16 at its respective ends and a lateral access valve connector 18 at the end of the stem 20 of the T-shape. The cross bar 12 is longitudinally bored, as at 22, and counterbored, as at 24, from its opposite end to form a through opening with the counterbore 24 extending toward the connector end 16 beyond the longitudinal axis of the stem 20.

The stem 20 is tubular and is connected, at one end, with the cross bar 12 medially its ends in a conventional manner so that the bore 26 of the stem communicates with the counterbore 24. The bores 22 and 26, with the inward end portion of the counterbore 24, form a right angular fluid passageway through the body. The other end of the stem 20 is provided with an annular flange 28, forming an annular shoulder 29 facing toward the cross bar 12. The stem 20 is further characterized by a tapered end surface 30 converging inwardly toward the axis of the stem for sealing with the end surface of a valve equipped access fitting 32 secured to a refrigerant line 34. The connector 18 comprises a sleeve nut retained on the stem 20 by the stem flange shoulder 29 with the nut threadedly engaging cooperating threads formed on the access fitting 32.

The access fitting is provided with a conventional air valve core 36 normally maintaining refrigerant gas, not shown, under pressure in the refrigerant line 34. The valve core 36 is provided with a depressible stem 38, normally spring biased closed, which, when depressed, permits communication with the refrigerant line 34 through the fitting 32 in a conventional manner.

Cam shaft means 40 is coaxially received by the counterbore 24. The cam shaft means comprises a shaft 42 having a longitudinal section of one end portion cut-away to form a cam 44 substantially semicircular in transverse section which is disposed within the inner end portion of the counterbore 24. Intermediate its ends, the shaft 42 is provided with an annular ring-like flange 46 forming opposing shoulders 48 and 50 with the shoulder 48 abutting the end of the cross bar 12 having the connector 14 secured thereto. The connector 14 comprises a sleeve nut which abuts the shoulder 50 and threadedly engages the adjacent end portion of the cross bar 12 but permits rotation of the shaft 42 about its longitudinal axis. That end portion of the shaft opposite the cam surface 44 projects coaxially beyond the nut connector 14 and is knurled, as at 52, for manually rotating the shaft. An indicator, such as an arrow 53, is scored on the end surface of the shaft opposite the cam 44 to indicate the access valve opened or closed position of the cam. An O-ring 54, disposed in a suitable groove, not shown, formed in the periphery of the shaft between the shoulder 48 and cam surface 44, forms a seal with the wall forming the counterbore 24.

Plunger means 56 is disposed within one end portion of the fluid passageway. The plunger means comprises a shank 58 longitudinally disposed within the stem 20 and having a length slightly greater than the length of the stem and provided with a disk-like head portion 60 at one end which contacts the cam 44. The other end of the shank 58 is disposed in close spaced relation with respect to the adjacent end of the depressible valve stem 38 so that, in the position shown by FIG. 3, the spring force acting on the valve core depressible stem 38 maintains the valve 36 closed and the plunger head 60 in contact with the cam 44.

The connector means 16 comprises a threaded end portion which cooperatively receives a threaded sleeve 62 forming one end portion of a conventional valve depressor refrigerant gas supply tubular member commonly called a "charging hose." The valve depressor, not shown, normally contained by the sleeve 62 is removed to permit a greater volume of fluid flow therethrough.

Figure 6:
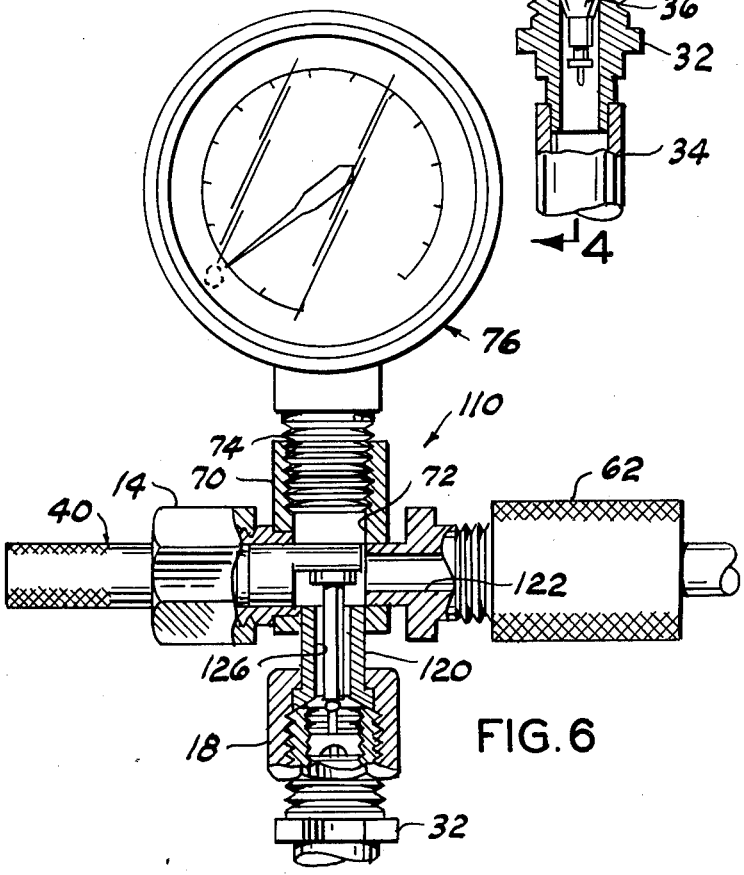
FIG. 6 is a view similar to FIG. 3 illustrating another embodiment.

Referring now to FIG. 6, another embodiment of the device is illustrated and indicated at 110 which is substantially identical to the embodiment 10 but is provided with an extension 70 formed on the body opposite the stem 120 which is centrally bored to form a port, as at 72, for communication with the passageway bores 122 and 126. The extension 70 is internally threaded adjacent its outer end, as at 74, for cooperatively receiving a pressure/vacuum gauge 76.

OPERATION

In operation the device 10 is connected by the connector means 18 to the access valve fitting 32. The connector means 16 is connected with the charging hose sleeve 62. The shaft 42 is manually rotated 180° from its position in FIGS. 3 and 4 about its longitudinal axis which longitudinally moves the plunger means 56 toward the air valve core stem 38 thus depressing the stem 38 and opening the access fitting 32. Additional refrigerant may then be added to the line 34 from the charging hose and when a desired pressure is reached the shaft 42 is again rotated 180° to its original position so that the valve core stem 38 is released and moves the plunger means 56 therewith and maintains contact between the plunger head 60 and the shaft cam surface 44.

In the event the refrigerant line 34 is to be evacuated of refrigerant gas, a second hose, not shown, is similarly connected with the connector means 16 in place of the sleeve 62 so that vacuum applied to the passageway quickly evacuates the refrigerant line 34 when the shaft 42 is rotated to open the access valve 34, as described hereinabove.

Operation of the other embodiment is substantially identical with the exception that the pressure/vacuum gauge 76 provides visual indication of pressure or vacuum in the passageway and line 34 when the valve core is opened by the cam 44.

Obviously the invention is susceptible to changes or alterations without defeating its practicability. Therefore, I do not wish to be confined to the preferred embodiments shown in the drawings and described herein.

I claim:

1. A manifold for evacuating and charging a closed refrigerant system with fluid, said refrigerant system having a refrigerant line provided with an access fitting containing a normally closed valve which must be depressed to open, comprising:

a body having a thorough bore and having a lateral bore intersecting the through bore, the lateral bore and one end portion of the through bore forming a fluid passageway;

access valve connector means connecting the lateral bore with said access fitting;

other connector means adapted to connect one end of a charging-evacuating hose with said one end portion of the through bore;

cam shaft means having an end portion disposed within the other end portion of the through bore; and, plunger means interposed between said access valve and said cam shaft means within the lateral bore.

2. The manifold according to claim 1 in which said cam shaft means includes:

a shaft having a cam surface formed on its end portion within the through bore, said shaft having a means at its other end portion adapted to permit manual rotation of said shaft about its longitudinal axis and indicate the orientation of said camming surface with respect to the normally closed valve.

3. The manifold according to claim 2 in which said plunger means includes:

a shank portion having one end contacting the depressible valve stem of said access fitting and having a head at its other end portion contacting said cam surface.

4. The manifold according to claim 3 in which said body is provided with a lateral threaded port communicating with the passageway and further including:

a pressure/vacuum gauge means connected with the threaded lateral port.

* * * * *